US005302029A

United States Patent [19]

Weber et al.

[11] Patent Number: 5,302,029

[45] Date of Patent: Apr. 12, 1994

[54] LARGE FLEXIBLE CONTAINER WITH REPLACEABLE INNER LINER

[76] Inventors: Ute Weber, Claudiusring 40e, 2400 Lübeck; Gerd Lange, Nachtigallenweg 8, 4950 Minden, both of Fed. Rep. of Germany

[21] Appl. No.: 39,183

[22] PCT Filed: Aug. 10, 1992

[86] PCT No.: PCT/EP92/01818

§ 371 Date: Apr. 13, 1993

§ 102(e) Date: Apr. 13, 1993

[87] PCT Pub. No.: WO93/03980

PCT Pub. Date: Mar. 4, 1993

[30] Foreign Application Priority Data

Aug. 14, 1991 [DE] Fed. Rep. of Germany ..... 4127201

[51] Int. Cl.[5] ..... B65D 30/26

[52] U.S. Cl. ..... 383/66; 383/16; 383/3; 383/101; 383/111; 383/119; 220/403

[58] Field of Search ..... 383/3, 16, 66, 100, 383/101, 102, 103, 111, 119; 220/403, 420, 460, 461, 530

[56] References Cited

U.S. PATENT DOCUMENTS 1,809,013 6/1931 Boardman .
2,507,939 5/1950 Smith ..... 383/111
3,167,209 1/1965 Jones .
3,510,142 5/1970 Erke ..... 383/3 X
3,578,050 5/1971 Weingarten et al. ..... 383/3 X
3,802,470 4/1974 Coleman .
3,965,953 6/1976 Becker .
4,099,656 7/1978 Neumann et al. ..... 383/3 X

FOREIGN PATENT DOCUMENTS 0116821 4/1984 European Pat. Off. .
1508236 11/1966 France .

*Primary Examiner*—Allan N. Shoap
*Assistant Examiner*—Jes F. Pascua
*Attorney, Agent, or Firm*—Salter, Michaelson & Benson

[57] ABSTRACT

A flexible storage container for the transportation of liquid foods, such as orange juice, includes an outer tearresistant shell having a linear closure in a front or end face thereof, and a replaceable inner liner which is inserted into the outer shell through the closure. The outer shell further includes a vent through which air can escape from the space between the inner liner and outer shell. The inner liner includes a filler fitting which is fed through the outer shell. The container is characterized in that it is elongated in shape and has a front or end face that bulges to conform to filling pressure. The front or end face is reinforced by a flexible bar that extend essentially perpendicular to the base. The container is further characterized in that the closure, and fittings for filling, emptying and venting are located in the front or end face.

6 Claims, 1 Drawing Sheet

LARGE FLEXIBLE CONTAINER WITH REPLACEABLE INNER LINER

BACKGROUND AND SUMMARY OF THE INVENTION

This invention relates to a large flexible container for gaseous, liquid, or pourable products with a tear-resistant outer shell and with a replaceable inner liner.

Large containers of this type are known from DE-PS 33 36 077. Besides the problems of undesirable air inclusions between the outer shell and the inner liner described in this German Patent, such large flexible containers can be handled only with difficulty when being set up and filled. The inner liner has to be introduced into the outer shell through the manhole, and to do this a man has to crawl into the outer shell to mount the fittings necessary for filling, emptying, and venting the inner liner. In this procedure, it is not impossible for dirt also to be introduced into the outer shell, which can destroy the relatively thin and sensitive inner liner even when being filled.

It is the purpose of this invention to propose a new design for such large flexible containers and a new procedure by which such containers can be set up and filled considerably more easily and with fewer problems.

According to the instructions of the invention, a large flexible container of this type is designed with a so-called front face from which the large container extends in an essentially elongated form. The cross-sectional shape of the large container is intended to be designed so that it conforms to the natural spreading forces of a drop of water standing on the bottom, to guarantee that no peak stresses can build up in the outer shell from the pressure of filling. This applies also to the front face, which has a bulged design corresponding to the filling pressure decreasing from bottom to top.

The front face thus provided is reinforced pursuant to the invention by at least one flexibly pliable bar that extends essentially perpendicular to the base over the front face when the container is filled. This reinforcement of the front face is necessary when the container is still untilled in order to be able to erect the front face of the outer shell ahead of time, i.e., to bring the front face into an almost vertical position after initially laying out the outer shell flat on the floor at the particular location, so that an operator can approach the front face without stepping on it. The pliable properties of such a reinforcing bar at the same time make it possible for the front face to bulge out later corresponding to the filling pressure when the container is being filled.

The erection of the front face requires a large container such that there is at least one point of attack for pulling at the top of the front face in the form of an eye or the like. The front face can then be erected relatively easily by means of a pull cord, especially when the pull cord is suitably pulled over a roller at a higher level (for example, on a tripod, a ladder, or the like). According to the instructions of the invention, both the manhole sealed linearly, preferably with a linear closure aligned essentially perpendicular to the bottom or to the base of the container, and all fittings necessary for filling, emptying, and venting the inner tank are also located on the front face.

This provides the advantage of the front operation pursuant to the invention. The inner liner can be inserted into the outer shell through the manhole in the front face, without having to enter the outer shell for the purpose, and at the same time, all of the necessary fittings that have to be connected to the inner liner and fed through the outer shell can also be assembled through the manhole in the front face, specifically without entering the outer shell, since according to the instructions of the invention all of the necessary fittings of the inner liner are positioned on the front face of the container, readily accessible after erection.

It is also very advantageous according to the instructions of the invention to provide a compressed air connector in the front shell that is readily accessible in the new large container for inflating only the outer shell.

A large container pursuant to the invention with the aforementioned basic features, suitable refinements of which will be described later, can be set up and filled especially easily and with no problems within the context of the problem posed by the invention, using the following operating procedure.

The new operating procedure is characterized by the fact that after laying out the outer shell flat on the floor at the particular location, the front face reinforced by at least one flexibly pliable bar is set up using the pulling force point of attack present at the top of the front face, whereupon the inner liner packed in the form of a roll is laid in the outer shell through the manhole on the front and without entering the outer shell, with the roll axis perpendicular to the lengthwise direction of the outer shell, and the fittings likewise to be mounted on the front face through the manhole are again connected without entering the outer shell, and by the fact that after sealing the manhole, only the outer shell is then largely inflated at first to stretch it out free of folds on the floor of the location, if necessary with the outer shell vent restricted or closed, and by the fact that the outer shell is then vented again somewhat so that it drops down somewhat in height and thereby stands flat on the floor with its base spread out, whereupon the inner liner still present in roll form is completely unrolled on the spread surface of the outer shell by introducing compressed air into the inner liner, and the inner liner is then filled with simultaneous venting of the outer shell.

A suitable design of the invention provides that the upper vent opening for the outer shell is located at the top of the front face, and that this vent opening has the form of an outer shell vent that can be sealed and/or restricted.

By means of such an outer shell vent at the top of the front face, the exhaust air can be controlled with no problems both when inflating only the outer shell and also during the subsequent venting of the outer shell to lower the height and spread out the base.

It is proposed for cost reasons that the outer shell vent at the top of the front face also serve at the same time in a structural unit as the compressed air connector for inflating only the outer shell.

It is also suggested as being very advantageous to provide the outer shell with tear-off vents or tear-off flaps, preferably in the lower corner areas of the large container, to vent the space between the outer shell and the inner liner, which can be operated from the front face of the large container by means of a pull cord or the like.

Such tear-off vents or tear-off flaps solve the venting problem of the air that may be enclosed between the outer shell and the inner liner while filling the container, very much more easily and more effectively than the combshaped spacing elements described for venting purposes in the mentioned DE-PS 33 36 077. Furthermore, such tear-off vents or tear-off flaps have the advantage that they stay closed at first, which is definitely helpful in the operating procedure according to the instructions of the invention for the initial inflation of only the outer shell, and are torn away, i.e. opened, only when it is necessary to vent between the outer shell and the inner liner when filling the container. Such tear-away vents or tear-away flaps can be particularly simple devices consisting of Velcro tape fasteners or a bar closure as shown in the drawing.

Another suitable embodiment of the invention provides for the linear closure of the manhole to extend essentially perpendicular to the base over the front face, and for the linear closure to consist of at least one flexibly pliable flat bar that can be pushed into loops in the manhole closure.

This flat bar or optionally two flat bars that constitute the manhole closure can at the same time perform the function of reinforcing the front face, so that in this case no separate additional bar is necessary just for reinforcing the front face.

It is especially suitable to extend the bar linear closure of the manhole up to the top area of the front face, and then to place at least the fittings for filling and venting the inner liner above the linear closure at the top of the front face. This permits the fittings for the inner liner to be mounted quickly and securely through the manhole by simply reaching through by hand.

Naturally, it is also again very economical with regard to the fittings for the inner liner to combine all of the fittings necessary for filling, emptying, and venting the inner liner into one structural unit, and to position this at the top of the front face. The container is then emptied from the top by means of a suction tube that is inserted into the inner liner through the fitting, and it is possible to fill and ventilate the inner liner with no problems anyhow through the structural unit located at the top.

The reinforcement of the front face of the flexible outer shell and its subsequent erection provided for by the instructions of the invention are facilitated in a suitable form of embodiment of the invention by the fact that the front face has two other flexibly pliable bars on the outside from the central manhole closure to reinforce the front face, which can be inserted into pocket loops on the front face of the outer shell, with the bars also being usable through cutouts between the pocket loops as a point of attack for pulling and/or as a handle.

BRIEF DESCRIPTION OF THE DRAWINGS

A structural example of embodiment of the invention will be described in detail below with reference to the drawings. The drawing shows.

DESCRIPTION OF THE PREFERRED EMBODIMENT

Figures 1, 2:
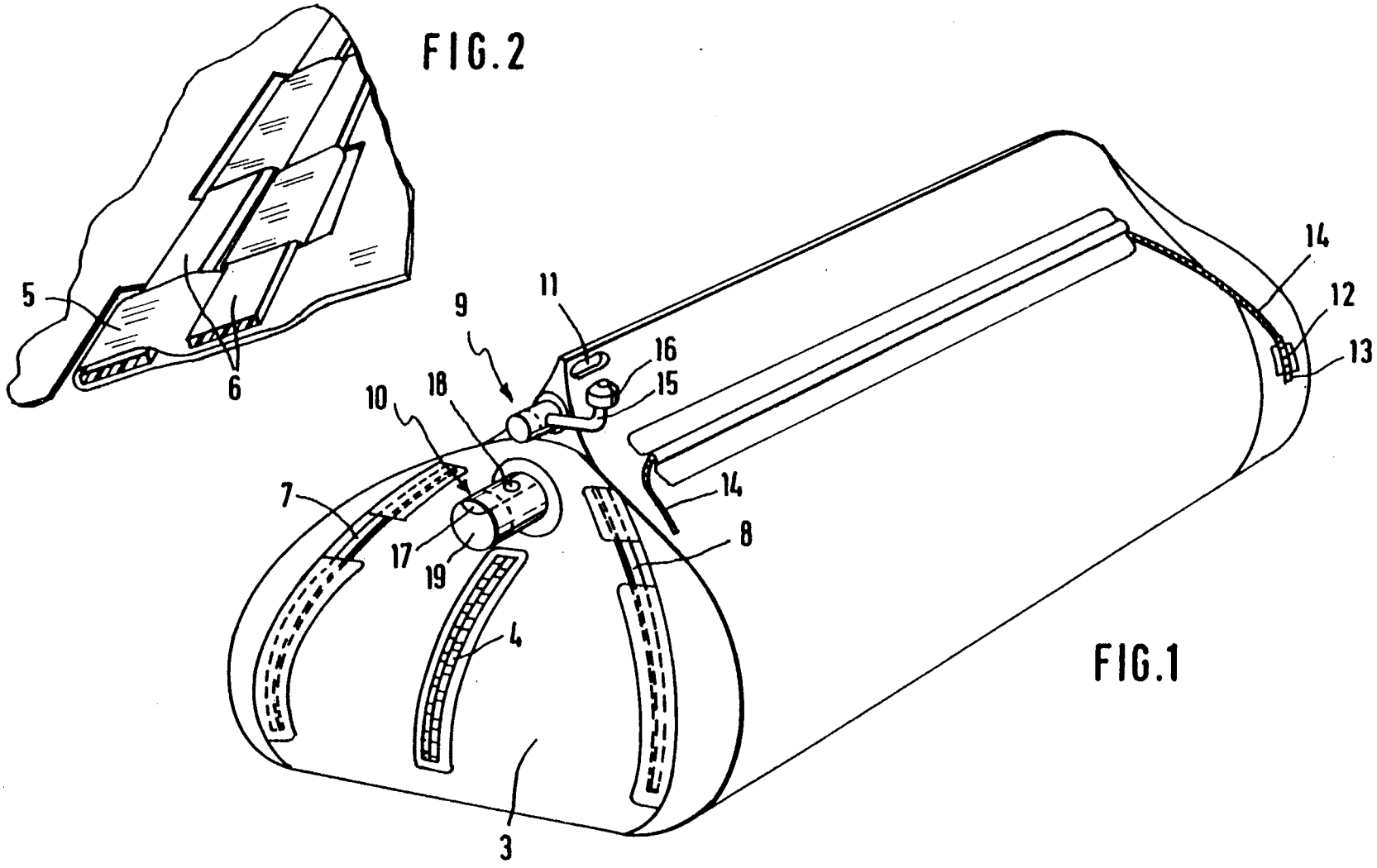
FIG. 1 A large container pursuant to the invention in perspective illustration.
FIG. 2 The manhole closure of the container of FIG. 1 in a detailed cutaway.

The flexible large container illustrated is in the filled condition, so that its outer shell and its inner liner fit against one another in shape. The inner liner is not shown separately in the drawing.

It can be seen that the large container has an essentially elongated shape with a front face 3 designed to bulge in conformity with the filling pressure. The manhole 4 is positioned at or on this front face with a linear closure that is illustrated in detail in FIG. 2.

The linear closure of the manhole extends essentially perpendicular to the base over the front face 3 and is composed of loops 5 in the example of embodiment illustrated in detail in FIG. 2, which are formed from the material of the outer shell and through which are pushed two flexibly pliable flat bars 6, as illustrated. The entire closure can have a tight film underlay and forms an effective seal of the manhole 4 largely impermeable to air.

These flat bars 6 of the manhole closure at the same time perform the function of reinforcing the front face of the container. The two additional flat bars 7 and 8, each of which is inserted outside of the manhole closure on the front face in an upper and a lower pocket loop, also fulfill the same function, with a space being maintained between each upper and lower pocket loop so that the flat bars 7 and 8 can very well be used as handles in this spaced area.

There are two fittings at the top of the front face. The upper fitting 9 is welded permanently into the outer shell and has no connection to the inner liner. The lower fitting 10, on the other hand, is connected to the inner liner and must be pushed through the outer shell or the front face 3 of the outer shell when erecting the flexible container after introducing the inner liner into the outer shell.

It is particularly easy to erect the large container. The outer shell is first laid out on the floor of the particular location, so that the front face can be reinforced by means of the flat bars 7 and 8. A cord is then looped through the eye 11 at the top of the front face, and the front face of the outer shell is erected by means of this cord and the handles formed by the flat bars 7 and 8. The erection of the reinforced front face of the outer shell forms a tent-like pointed cavity just behind this front face, which makes it possible then to insert the inner liner into the outer shell through the open manhole without the necessity of a man crawling into the outer shell or entering it for this purpose. After inserting the inner liner, the fitting 10 of the inner liner can likewise be fed through the front face of the outer shell with no problems simply by hand through the open manhole.

The linear closure of the manhole 4 is then closed by pushing the flat bars 6 into the particular loops 5. This type of closure has the advantage that the linear closure takes part with no problems in the later bulging of the front face that occurs in conformity with the filling pressure of the container, but at the same time it has high load capacity in the transverse direction because of the high section modulus of the flat bars in this direction.

It is desirable by this time after erecting the front face, to check once again that the tear-off closures 12 located in the back lower corner areas of the large container are likewise closed. In structural regards, the tear-off closure 12 illustrated in FIG. 1 is designed similarly to the linear closure of the manhole 4, but it has only one flat bar 13, which can be pulled out of the closure loops from the front face by means of the pull cord 14, because of which the outer shell then has a vent opening at this point through which any air enclosed between the outer shell and the inner liner can escape. Naturally, such tear-off closures can also be located at all points on the container at risk of having undesirable air inclusion. At first, however, all such tear-off closures must be kept closed.

The outer shell is then inflated to a great extent through the fitting 9 to stretch it out without folds. A compressed air hose is connected to the fitting 9 for this purpose, and the open vent area of the vent pipe 15 is restricted or closed by means of the cap 16 resting on end on a threaded part of the pipe.

When the outer shell is stretched out free of folds, the vent 15, 16 is opened again so that the outer shell drops somewhat in height and stands flat on the floor because of this with a spread-out base. This forms a sufficiently large inner chamber in the outer shell so that the inner liner can then unfold in the outer shell with no problem.

The inner liner is unfolded by introducing compressed air into the fitting 10. The fitting 10 has the following structural design. In principle, it is a simple pipe connector that is connected to the inner liner with clamping flanges, but may also be welded into it, for example if the pipe connector is injection-molded from a plastic. The pipe connector is subdivided into two open passages in the interior. The smaller passage 17 permanently connects the inner chamber of the inner liner with the atmosphere through the outer bore 18 (permanent venting). At the head end, which is the end facing the viewer in the illustration, the small passage is sealed by a partition so that no product can reach and plug the vent area when filling the inner liner. The larger area 19 of the pipe connector is optionally used for filling or emptying the inner liner, with a suction tube being inserted through the larger passage 19 of the fitting 10 into the inner liner for emptying.

If the compressed air introduced to unfold the inner liner in the outer shell is insufficient because of the permanent venting of the inner liner, the outer bore 18 of the permanent vent can then be kept closed or closed mechanically for a short time with no problems.

It is clear from the illustration of FIG. 1 that the design of a flexible large container with a front face that must be reinforced for erection, and with the arrangement of all necessary fittings and closures in or on the front face (=front operation) provides considerable simplification in the handling of such large containers during erection and filling.

Handling is also improved with the example of embodiment of the invention illustrated by the fact that there are only two fittings in the front face, namely one for the outer shell and one for the inner liner, and that each of the two fittings as a structural unit permits all of the functions desired for the particular containers connected to them.

Such front operation at the front face of the flexible large container also has the advantage that several large containers if necessary can be set up in parallel contact side by side, so that substantial space saving is possible in warehouses, on ships, trucks, or other transport vehicles.

We claim:

1. A flexible container for holding gaseous, liquid or pourable products comprising:

an outer tear-resistant shell which is impermeable to air, said outer shell having a linear closure;

a replaceable inner liner which is inserted into said outer shell through said closure;

venting means in said outer shell through which air between said inner liner and said outer shell can escape; and means for filling and emptying said inner liner, said filling and emptying means extending through said outer shell, said container being characterized in that said container is substantially elongate in shape and has a front face that bulges to conform to filling pressure, said front face is reinforced by at least one flexibly pliable bar that extends perpendicular to a base of the container, and said closure, said filling and emptying means, and said venting means are located on said front face.

2. The container of claim 1 wherein said front face includes a compressed air connector for inflating said outer shell.

3. The container of claim 1 wherein said linear closure extends over said front face substantially perpendicular to the base of said container, said linear closure comprising loops on said outer shell and at least one flexibly pliable flat bar which is inserted into said loops.

4. The container of claim 1 wherein said front face includes pocket loops adjacent said linear closure, and two flexibly pliable bars which are inserted into said pocket loops, said bars being operable for reinforcing said front face and further being operable as handles.

5. The container of claim 1 wherein said venting means is located at a top portion of said front face, said vent means comprising a vent which is adjustably movable between an open and closed position.

6. The container of claim 1 wherein said outer shell includes tear-off vents for venting the space between the outer shell and the inner liner, said tear-off vents being located at lower portions of said container and being operable from the front face of said container by pull cords.

* * * * *